US008863469B2

(12) United States Patent
Curtis et al.

(10) Patent No.: US 8,863,469 B2
(45) Date of Patent: Oct. 21, 2014

(54) THERMAL CLIP ATTACHMENT APPARATUS FOR MASONRY ANCHORS AND METHODS THEREOF

(71) Applicant: Heckmann Building Products Inc., Melrose Park, IL (US)

(72) Inventors: Paul Curtis, Oak Park, IL (US); David Sanchez, Brookfield, IL (US)

(73) Assignee: Heckmann Building Products Inc., Melrose Park, IL (US)

( * ) Notice: Subject to any disclaimer, the term of this patent is extended or adjusted under 35 U.S.C. 154(b) by 0 days.

(21) Appl. No.: 13/776,048

(22) Filed: Feb. 25, 2013

(65) Prior Publication Data

US 2013/0232909 A1 Sep. 12, 2013

Related U.S. Application Data

(60) Provisional application No. 61/602,178, filed on Feb. 23, 2012.

(51) Int. Cl.

| | |
|---|---|
| ***E04B 1/16*** | (2006.01) |
| ***E04B 1/38*** | (2006.01) |
| ***E04C 1/40*** | (2006.01) |
| ***E04B 1/00*** | (2006.01) |
| ***E04B 1/41*** | (2006.01) |
| ***E04B 2/30*** | (2006.01) |

(52) U.S. Cl.

CPC ..... *E04B 1/4178* (2013.01); *E04B 2/30* (2013.01)

USPC ..... 52/712; 52/379; 52/513; 52/745.21

(58) Field of Classification Search

CPC ... E04B 1/4178; E04B 1/4185; E04B 1/7616; E04B 1/7637

USPC ..... 52/378, 379, 383, 426, 513, 562, 565, 52/582.1, 698, 707, 712, 713, 745.21

See application file for complete search history.

(56) References Cited

U.S. PATENT DOCUMENTS

| | | | | |
|---|---|---|---|---|
| 2,413,425 | A * | 12/1946 | Anderson et al. | 52/379 |
| 4,473,984 | A | 10/1984 | Lopez | |
| 4,598,518 | A | 7/1986 | Hohmann | |
| 4,764,069 | A | 8/1988 | Reinwall et al. | |
| 4,869,038 | A | 9/1989 | Catani | |
| 6,131,360 | A * | 10/2000 | Dalen | 52/712 |
| 7,415,803 | B2 | 8/2008 | Bronner | |
| 7,913,470 | B2 * | 3/2011 | Siodla et al. | 52/586.2 |
| 8,215,073 | B2 * | 7/2012 | Gorman et al. | 52/202 |
| 8,516,763 | B2 * | 8/2013 | Hohmann, Jr. | 52/506.05 |
| 8,544,228 | B2 * | 10/2013 | Bronner | 52/378 |
| 8,555,596 | B2 * | 10/2013 | Hohmann, Jr. | 52/712 |

(Continued)

*Primary Examiner* — Ryan Kwiecinski

(74) *Attorney, Agent, or Firm* — Jeffrey A. Pine; Dykema Gossett PLLC

(57) ABSTRACT

A thermal clip attachment apparatus and methods for using the thermal clip attachment with a masonry veneer anchor system are disclosed. The thermal clip attachment may be a composite piece that attaches to the part of a stud that protrudes from an inner structural supportive wall after the stud is advanced into the wall. The thermal clip attachment serves as a thermal break between the stud and an outer masonry veneer wall. Further, the thermal clip attachment also serves as an attachment point for a wire tie, which allows a positive lateral load connection to be established between the outer masonry veneer wall and the inner structural supportive wall.

8 Claims, 16 Drawing Sheets

(56) References Cited

U.S. PATENT DOCUMENTS

| | | | | |
|---|---|---|---|---|
| 8,596,010 | B2 * | 12/2013 | Hohmann, Jr. | 52/565 |
| 2005/0279042 | A1 * | 12/2005 | Bronner | 52/513 |
| 2008/0141605 | A1 * | 6/2008 | Hohmann | 52/408 |
| 2008/0295651 | A1 * | 12/2008 | Nilsen et al. | 81/180.1 |
| 2009/0133357 | A1 * | 5/2009 | Richards | 52/698 |
| 2010/0037552 | A1 * | 2/2010 | Bronner | 52/713 |
| 2011/0094176 | A1 * | 4/2011 | Bronner | 52/506.05 |
| 2011/0277397 | A1 * | 11/2011 | Hohmann, Jr. | 52/167.1 |
| 2012/0285111 | A1 * | 11/2012 | Johnson, III | 52/379 |
| 2012/0291390 | A1 * | 11/2012 | Hohmann, Jr. | 52/565 |
| 2013/0008121 | A1 * | 1/2013 | Dalen | 52/704 |
| 2013/0247482 | A1 * | 9/2013 | Hohmann, Jr. | 52/167.1 |

* cited by examiner

Prior Art

Prior Art

Prior Art

Prior Art

Model 3

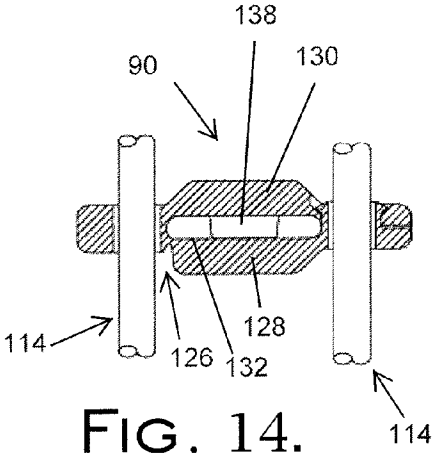
FIG. 12A.
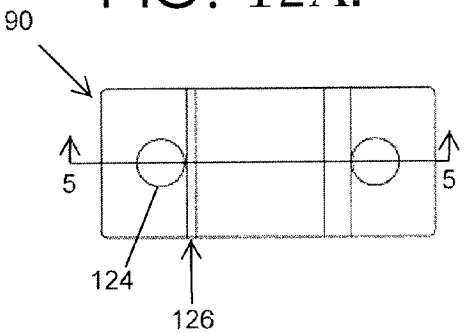
FIG. 12B.
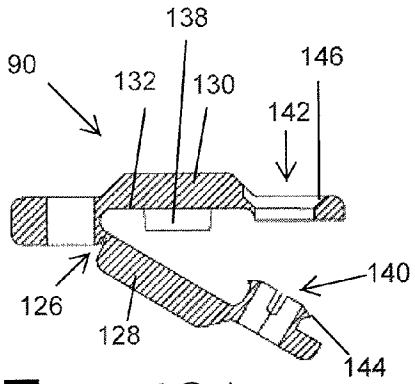
FIG. 13A.
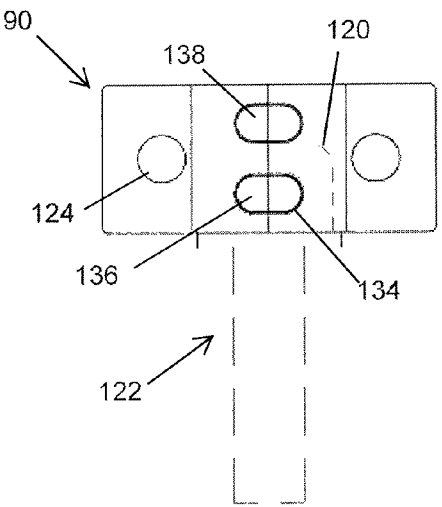
FIG. 13B.
FIG. 14.

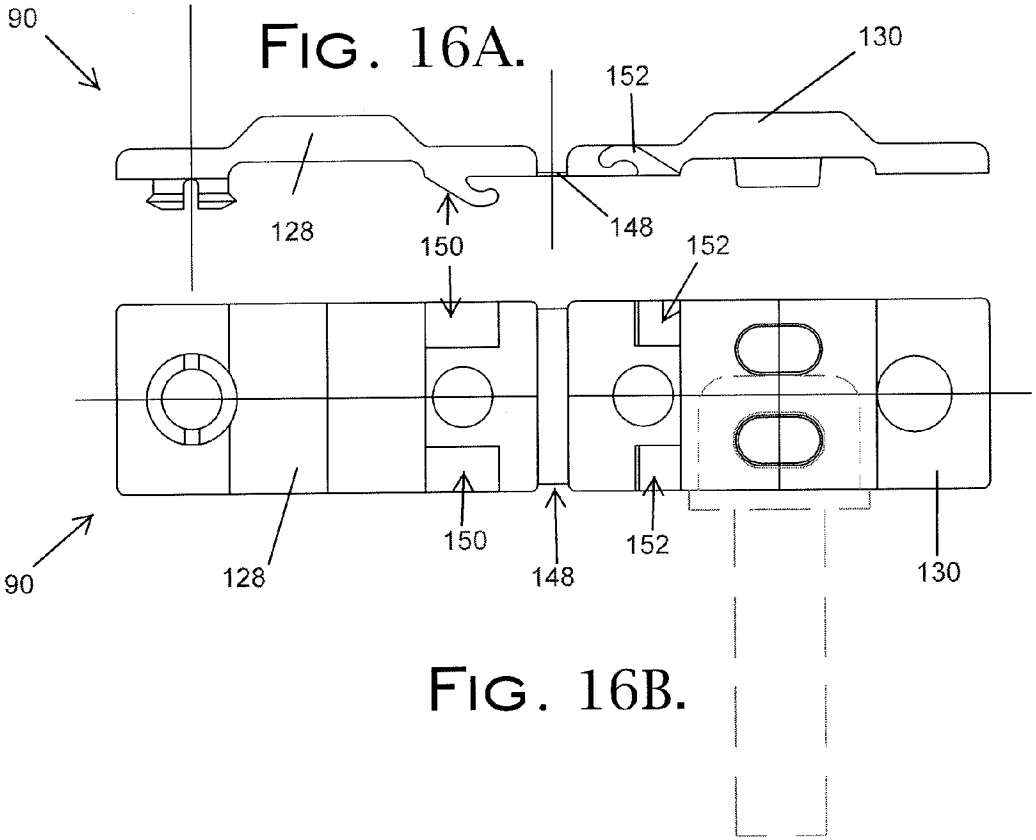
FIG. 16A.
FIG. 16B.
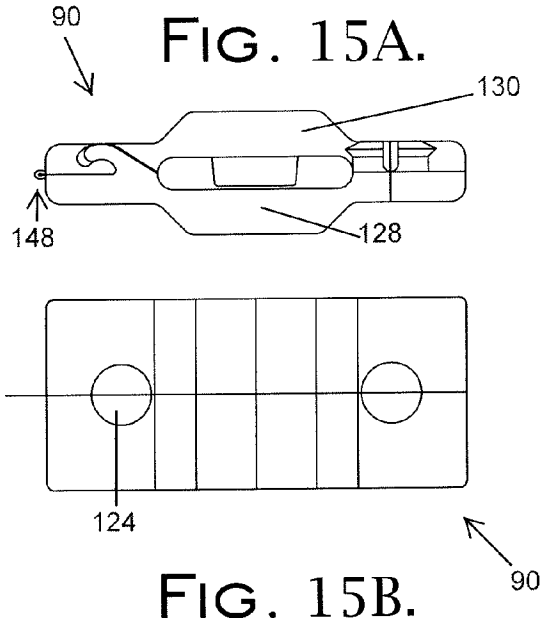
FIG. 15A.
FIG. 15B.

THERMAL CLIP ATTACHMENT APPARATUS FOR MASONRY ANCHORS AND METHODS THEREOF

PRIORITY STATEMENT

This application claims the benefit of U.S. Provisional Application No. 61/602,178, filed Feb. 23, 2012.

FIELD OF THE INVENTION

The present invention relates generally to a masonry veneer anchor system and, more specifically, to a thermal clip attachment for a masonry veneer anchor system.

BACKGROUND OF THE INVENTION

Masonry veneer anchor systems are used to establish a positive lateral load connection between an outer masonry veneer wall and an inner structural supportive wall. Typically, one end portion of a self-drilling, self-tapping stud is screwed into a stud holder formed by a generally cylindrical barrel having an integral, tongue-like driving head on one end thereof. An eye for a wire tie is formed through the driving head while cutting elements are formed on the end of the barrel opposite the head.

Oftentimes the stud is adapted to be driven by a power-rotated socket, which is sized and shaped to telescope into driving engagement with the driving head of the stud holder. When the stud is driven, it drills through a layer of insulation on a supportive wall and then drills and taps into the supportive wall itself. During driving of the stud, the cutting elements on the barrel of the stud holder drill a counterbore in the insulation to receive the barrel so as to cause the barrel to seat itself and the stud tightly in the insulation and the supportive wall.

After the stud and the stud holder have been driven, one portion of a wire tie is threaded through the eye of the driving head while another portion of the wire is embedded in the mortar or other cement-like material of a masonry veneer wall disposed alongside the supportive wall. The wire tie provides a positive lateral load connection between the masonry veneer wall and the supportive wall.

Some variants of masonry veneer anchor systems utilize wing nut attachments that are mounted on the stud holder. Wing nut attachments can provide more secure attachment points for the wire tie and can, depending on a material composition such as plastic, create a thermal break between the stud holder and the wire tie. The thermal break can reduce the amount of thermal energy transfer between the outer masonry veneer wall and the internal supportive wall. But such wing nut attachments are mounted to the stud holder before the stud holder is driven into the insulation and supportive wall. One disadvantage of the current masonry anchor design is that the arrangement can cause abrasions if an installer's hand slips off of the drive mechanism and makes contact with the spinning wing nut attachment as the stud holder is driven into place. Further, some wing nut attachments may require the stud holder to have external threads that mate with internal threads of the wing nut. These thread assemblies add unnecessary costs to both the stud holder and the wing nut. Also, in some installments, there is a delay between the time the masonry anchors are installed in the internal supportive wall and the time that the outer veneer wall is built. During this delay, the wing nut attachment may be subjected to the elements, including the sun, for a length of time. Certain plastic material can be damaged by the radiation given off by the sun.

Thus, there is a long felt need in the field of masonry veneer anchor systems for a cost-effective thermal clip attachment that can serve as a thermal break, that attaches to the stud holder after the stud holder is driven into the insulation and supportive wall, and that works with existing types of stud holders.

SUMMARY OF THE INVENTION

The present invention aims to provide a new and improved masonry veneer anchor system and, more specifically, a thermal clip attachment for the anchor system. The masonry veneer anchor system, which is intended to establish a positive lateral load connection between an outer masonry veneer wall and an inner structural supportive wall, may generally include a stud, a thermal clip attachment, and a wire tie.

The stud may include a stud driver and holder, a threaded stud, combinations thereof, or an integral one-piece stud. The stud may be sized, threaded, shaped, and formed so that it may be advanced through a layer of insulation adjacent to the interior structural supportive wall and through, or at least into, the interior structural supportive wall. The stud may also include a part that is intended to receive the thermal clip attachment. When advancing the stud into the layer of insulation and the interior structural supportive wall, the part that receives the thermal clip attachment may be left to protrude from the layer of insulation.

The thermal clip attachment may be a composite piece that attaches to the part of the stud that protrudes from the layer of insulation. Moreover, the thermal clip attachment may be made of a non-conducting material to serve as a thermal break between the stud and the outer masonry veneer wall. The thermal clip attachment may have holes or other points of attachment for connection to extensions of a wire tie, which is used to secure the stud to the outer masonry veneer wall.

The thermal clip attachment can have many embodiments. One advantage of the merely exemplary embodiments described herein is that the thermal clip attachment can be used with existing types of studs.

In one embodiment, the thermal clip attachment has a cavity for selectively receiving an outer driving head of the stud. The thermal clip attachment may also include a resilient prong having a lip, with the resilient prong generally disposed throughout a portion of the cavity. When the cavity of the thermal clip attachment is forced onto the outer driving head of the stud, the prong is temporarily displaced until the lip of the prong catches an eye, or opening, in the outer driving head of the stud. At that point, the prong snaps back into place and secures the outer driving head within the cavity.

In another embodiment, the thermal clip attachment includes first and second portions. The first and second portions may form a cavity for receiving the part of the stud that protrudes from the layer of insulation. Further, the first and second portions may be rotatable relative to one another, and the first and second portions may be selectively fastened to one another. Thus, the first and second portions may be placed in an open position to receive a part of the stud. Once the part of the stud is secured within the cavity the first and second portions are rotated back to a closed position and fastened to one another. One exemplary way to secure the part of the stud within the cavity is to place an opening of the part of the stud around a peg, which is fixed within the cavity as an integral part of the thermal clip attachment. After the thermal clip attachment is affixed to the stud, the wire tie may be connected to both the thermal clip attachment and the outer masonry wall.

BRIEF DESCRIPTION OF THE DRAWINGS

The preferred embodiments of the invention will be described in conjunction with the appended drawings, which illustrate and do not limit the invention, where like designations denote like elements, and in which:

FIG. 9G shows a thermal clip attachment after insertion of the stud driver and holder.

FIG. 12A shows a cross-sectional view taken substantially along the line 5-5 in FIG. 12B of another embodiment of a thermal clip attachment in a closed position in accordance with the present invention.

FIG. 12B shows a side view of the thermal clip attachment of FIG. 12A in accordance with the present invention.

FIG. 13A shows a cross-sectional view similar to that in FIG. 12A, in an open position in accordance with the present invention.

FIG. 13B shows a side view of the thermal clip attachment of FIGS. 12A, 12B, and 13A in a closed position, with an outer driving head of a stud driver and holder (shown in hidden) clamped within the thermal clip attachment in accordance with the present invention.

FIG. 14 shows a cross-sectional view of the thermal clip attachment of FIGS. 12A, 12B, 13A, and 13B, with extensions of a wire tie inserted through holes of the thermal clip attachment in accordance with the present invention.

FIG. 15A shows a top view of an alternative embodiment of a thermal clip attachment in a closed position in accordance with the present invention.

FIG. 15B shows a side view of the thermal clip attachment of FIG. 15A in accordance with the present invention.

FIG. 16A shows a top view of the thermal clip attachment of FIGS. 15A and 15B, in an open position in accordance with the present invention.

FIG. 16B shows a side view of the thermal clip attachment of FIGS. 15A, 15B, and 16A in an open position, with an outer driving head of a stud driver and holder (shown in hidden) positioned near one portion of the thermal clip attachment in accordance with the present invention.

DETAILED DESCRIPTION OF EMBODIMENTS OF THE INVENTION

Figure 1:
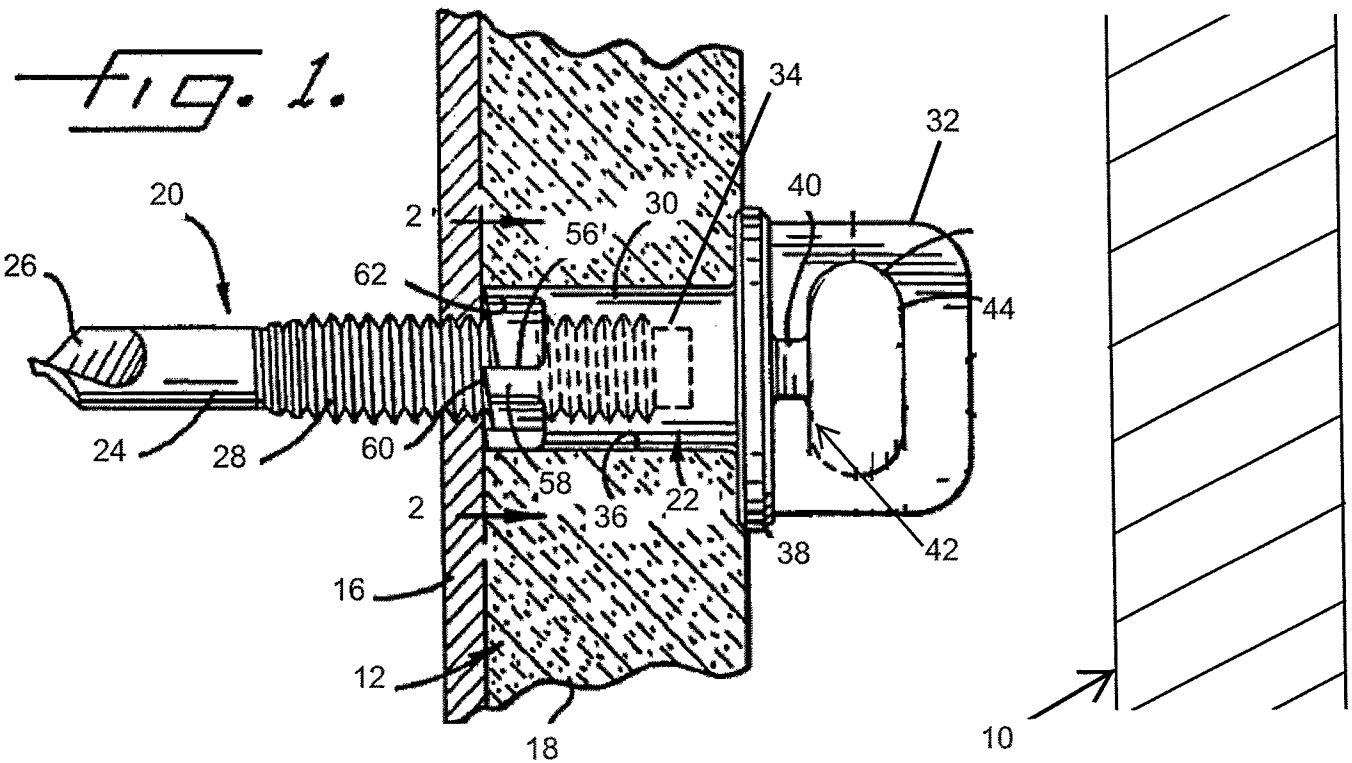
Prior Art FIG. 1.
FIG. 1 is a sectional view of a masonry veneer wall and a supportive wall having a partial anchoring system.

Before proceeding to a description of the thermal clip attachment apparatus and methods of using the same, it is helpful to discuss some of the other components used in a system for establishing a positive lateral load connection between an outer masonry veneer wall 10 and an inner structural supportive wall 12, such as the partial masonry anchoring system 14 shown in FIG. 1. Noticeably absent from FIG. 1 are a wire tie and the thermal clip attachment, which are described below with reference to FIGS. 9 through 19.

The outer masonry veneer wall 10 can be formed, for example, from bricks that are joined to one another by mortar or other cementitious material. In some embodiments, the inner structural supportive wall 12 may be formed by an inner sheet of thin steel 16 and by an outer layer 18 of hard, rigid, fire-resistant insulation, such as that sold by Weyerhaeuser under the trademark ULTRABOARD, for example.

In general, the masonry anchoring system 14 may comprise four basic components, namely, a threaded stud 20, a stud driver and holder 22, a thermal clip attachment (not shown), and a wire tie (not shown). In the embodiment shown in FIG. 1, the threaded stud 20 may include an elongated metal shank 24 formed with a self-drilling tip 26 and formed with a self-tapping machine thread 28. When the threaded stud 20 is driven by being rotated and advanced axially, the self-drilling tip 26 drills through the insulation 18 and the inner sheet of thin steel 16 and then the self-tapping machine thread 28 screws itself into the inner sheet of thin steel 16.

The stud driver and holder 22 may generally include an elongated cylindrical barrel 30 formed integrally with an outer driving head 32, which may be in the form of a flat, axially projecting tongue of generally rectangular shape and generally rectangular cross-section. The stud driver and holder 22 may be, for example, die cast from a zinc-aluminum alloy or stainless steel.

An axially extending threaded hole 34 may be formed in the inner end portion of the barrel 30 of the stud driver and holder 22. The axially extending threaded hole 34 may be sized to receive the outer end portion of the self-tapping machine thread 28 of the threaded stud 20. The threaded stud 20 may be screwed snugly into the elongated cylindrical barrel 30 by hand before the threaded stud 20 and stud driver and holder 22 are driven. As described below, when the threaded stud 20 is driven, the elongated cylindrical barrel 30 drills through the insulation 18 and forms an enlarged counterbore 36, which receives the elongated cylindrical barrel 30 in the finally installed position of the threaded stud 20.

Figure 2:
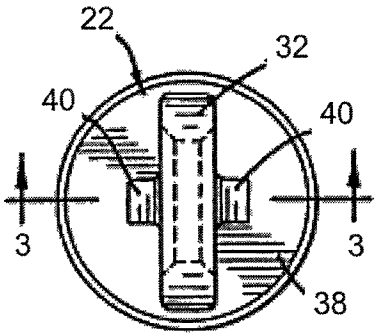
FIG. 2. Prior Art
FIG. 2 is an end view of an outer driving head of a stud driver and holder that is used in the anchoring system.
Figure 3:
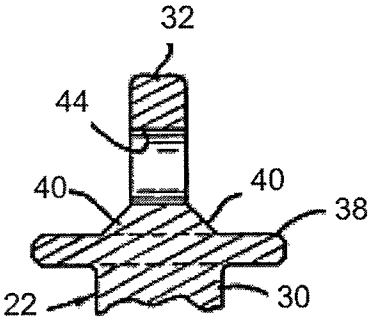
FIG. 3. Prior Art
FIG. 3 is a fragmentary cross-sectional view of the outer driving head taken substantially along the line 3-3 of FIG. 2.

With continued primary reference to FIG. 1, an enlarged, radially-extending, circular flange 38 may be formed as an integral part of the stud driver and holder 22. FIG. 2, however, provides an end view of the circular flange 38 and the outer driving head 32, while FIG. 3 provides a fragmentary cross-sectional view taken substantially along the line 3-3 of FIG. 2. The circular flange 38, which need not necessarily be circular, may be located between the outer end of the elongated cylindrical barrel 30 and the inner end of the outer driving head 32. The circular flange 38 may work with a pair of gussets 40 that increase the strength of the outer driving head 32 when torque is applied to the outer driving head 32 during installation of the threaded stud 20 and the stud driver and holder 22. The pair of gussets 40 may be formed integrally with opposite sides of the outer driving head 32 midway along the length of an inner long edge 42 of an eye 44 of the outer driving head 32 and at junctions between the outer driving head 32 and the circular flange 38. The gussets 40 may be generally triangular in cross-section and serve to reinforce the joint between the outer driving head 32 and the circular flange 38 so as to prevent the outer driving head 32 from shearing away from the circular flange 38 when high torque is applied to the outer driving head 32.

Figure 4:
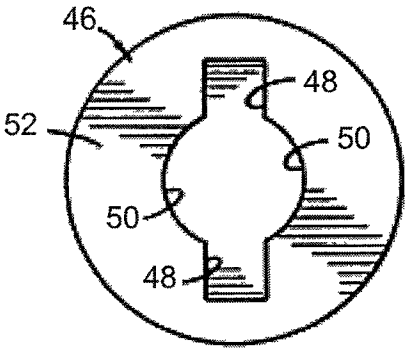
FIG. 4 is an end view of a power-rotated driving tool having a socket that is contoured to receive the outer driving head in FIG. 2.

Driving of the threaded stud 20 and the stud driver and holder 22 may be effected by an automatic screw gun (not shown) having a power-rotated driving tool 46, as shown in a bottom view in FIG. 4. The power-rotated driving tool 46 may be formed with a socket 48 that is shaped to couple drivingly with the outer driving head 32 of the stud driver and holder 22. The socket 48 of the driving tool 46 may be formed with arcuate notches 50, which can accommodate the gussets 40 when the socket 48 is telescoped into driving relation with the outer driving head 32. The socket 48 generally may be shaped as an elongated slot formed in the driving tool 46 and opening out of a flat driving face 52 thereof. The cross-sectional size and shape of the socket 48 may correspond substantially to the cross-sectional size and shape of the outer driving head 32.

As the stud driver and holder 22 is driven into place, the outer side of the circular flange 38 may squarely engage the flat driving face 52 of the driving tool 46 and serve to stabilize the stud driver and holder 22 in the socket 48 as the stud driver and holder 22 is rotated and advanced axially. When the threaded stud 20 is fully driven, the inner face of the circular flange 38 may seat tightly against an outer side of the insulation 18 and thus may serve as a washer to close off and seal the enlarged counterbore 36 in the insulation 18. For the circular flange 38 to effectively close off the enlarged counterbore 36, the diameter of the circular flange 38 may be significantly greater than the diameter of the elongated cylindrical barrel 30. The elongated cylindrical barrel 30 of one exemplary stud holder and driver 22 may have a diameter of about ⅜" while the flange has a diameter of about ¾".

In the alternative, a separate washer (not shown) may be mounted around the stud holder and driver 22 beneath the circular flange 38. The separate washer may, in some embodiments, be formed by using adhesive to mount a composite layer to a bottom of a metallic layer. Once mounted on the stud holder and driver 22, the metallic layer may be closest to the circular flange 38, while the composite layer could mate with a surface of the insulation 18 surrounding the enlarged counterbore 36. The separate washer may be advantageous in that the composite layer may be more suitable for mating with the insulation 18. For example, the composite layer may be softer and hence more gentile on the insulation 18 and may also form a more-airtight seal with the insulation 18, as compared to the circular flange 38 or the metallic layer of the separate washer. Moreover, the metallic layer could be slightly resilient and have inwards concavity, that is, concavity towards the insulation 18. By slightly deforming the metallic layer during installation, the metallic layer would assist in both maintaining the composite layer against the insulation 18 and maintaining a degree of tension in the joint.

Figure 5:
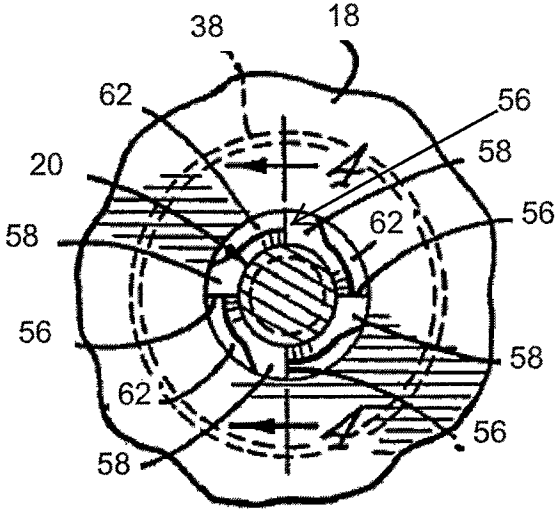
FIG. 5 is a fragmentary cross-sectional view of the partial anchoring system taken substantially along line 2-2 of FIG. 1.

To enable the elongated cylindrical barrel 30 to drill the enlarged counterbore 36 effectively through insulation 18, which is both hard and rigid, and through insulation 54 (see, e.g., FIG. 7), which is soft and compressible, the inner end portion of the elongated cylindrical barrel 30 of the stud driver and holder 22 may be formed with cutting elements 56, as shown in FIG. 1. Alternative views of the cutting elements 56 can be seen in FIGS. 5 and 6. FIG. 5 is a fragmentary cross-sectional view along the line 2-2 of the partial anchor system shown in FIG. 1, and FIG. 6 is a fragmentary cross-sectional view taken substantially along the line 4-4 of FIG. 5.

In one embodiment, shown best in FIG. 5, there may be four cutting elements 56 in the form of cutting edges that are spaced angularly around and extending axially along the inner end portion of the elongated cylindrical barrel 30, parallel to an axis thereof. The cutting edges may be defined by the outer leading edges of four angularly spaced ribs 58 and lie on a cutting circle having the same diameter as the outer diameter of the elongated cylindrical barrel 30. Tips 60 of the ribs may be inclined at a negative axial rake angle of about 10 degrees, as shown best in FIGS. 1 and 6.

Figure 6:
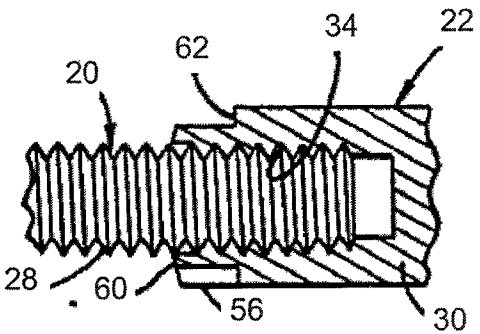
FIG. 6. Prior Art
FIG. 6 is a fragmentary cross-sectional view of a stud driver and holder and a threaded stud taken substantially along line 4-4 of FIG. 5.

FIG. 6 also shows relieved flutes 62, which may be formed between the angularly spaced ribs 58 and extend axially along the elongated cylindrical barrel 30 between the cutting elements 56 of the angularly spaced ribs 58. The bottoms of the relieved flutes 62 may be convexly arcuate and lie along a common circle having a diameter less than the outer diameter of the barrel. The relieved flutes 62 may define pockets that store the material of the insulation when the enlarged counterbore is drilled through the insulation.

As a result of the axially extending and angularly spaced cutting elements 56, the elongated cylindrical barrel 30 may be capable of drilling through very hard insulation 18 such as ULTRABOARD. In addition, the barrel is capable of drilling a clean enlarged counterbore 36 through soft and compressible insulation 54, such as the polystyrene insulation shown in FIG. 7, for example, without crushing or packing the material into the enlarged counterbore 36. As the soft material is cut away, it is stored in the pockets defined by the relieved flutes 62 and does not interfere with the action of the cutting elements 56 penetrating the material.

Figure 7:
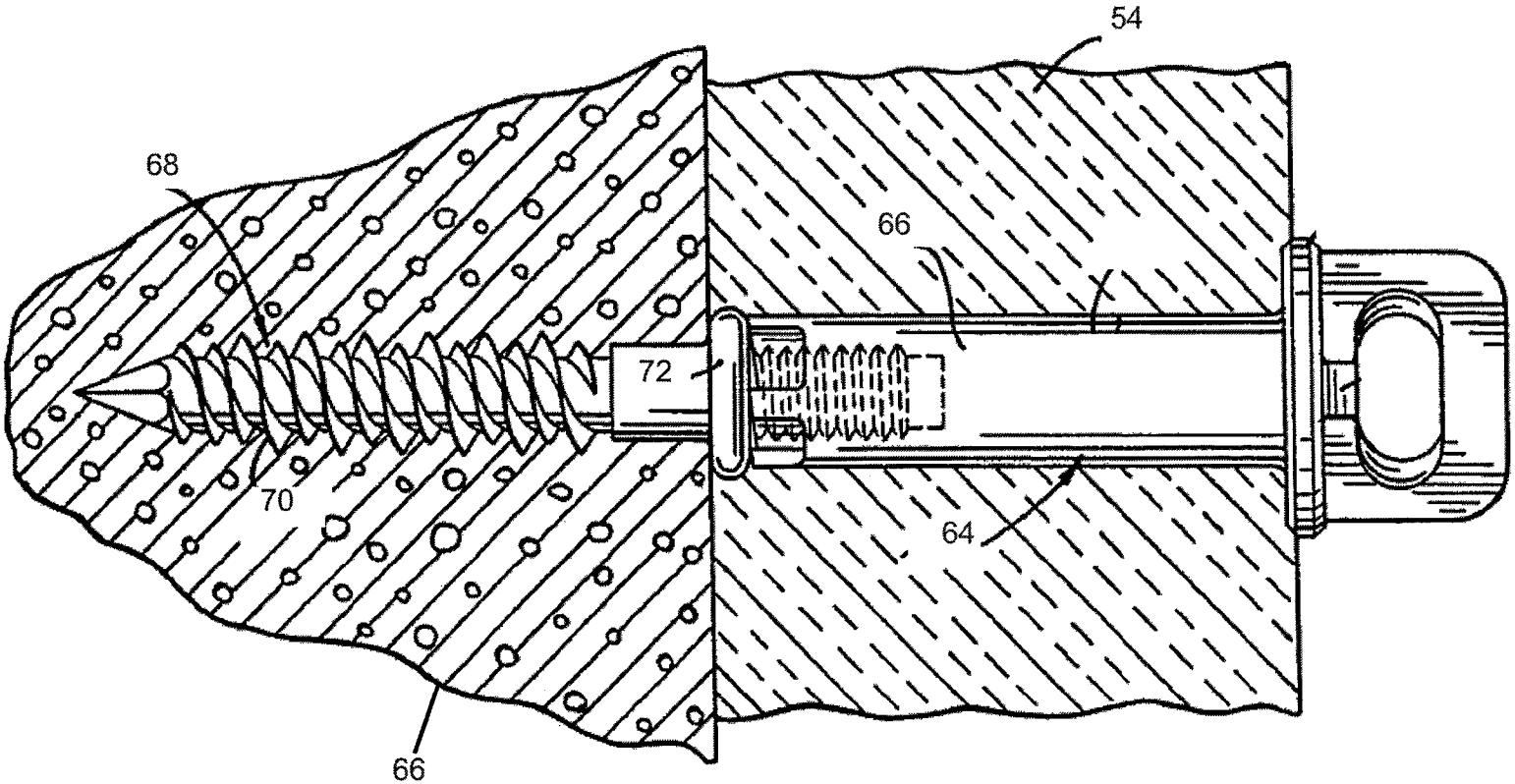
FIG. 7 is a side view of another embodiment of a stud driver and holder for use in an anchoring system.

As one skilled in the art will appreciate, the present invention may be used with a wide variety of stud holders. For example, another embodiment of a stud driver and holder 64 is shown in FIG. 7. The stud driver and holder 64 in FIG. 7 may be similar to the stud driver and holder 22, except that an elongated cylindrical barrel 66 of the stud driver and holder 64 of FIG. 7 may be longer to enable it to penetrate substantially the entire thickness of the relatively thick polystyrene insulation 54. In FIG. 7, the insulation 54 is shown as attached to a comparatively thick concrete wall 66 and thus the inner end portion of a threaded stud 68 is formed with a masonry thread 70 while the outer end portion of the threaded stud 68 is formed with a machine thread in the same manner as the threaded stud 20. The threaded stud 68 may be ideal for drilling through concrete or a concrete masonry unit (CMU), for example. Further, a flange 72 may be formed between the two threads of the threaded stud 68 and engage the outer side of the concrete wall thick concrete wall 66 and the inner end of the stud driver and holder 64 when the stud driver and holder 64 is fully tightened.

Figure 8:
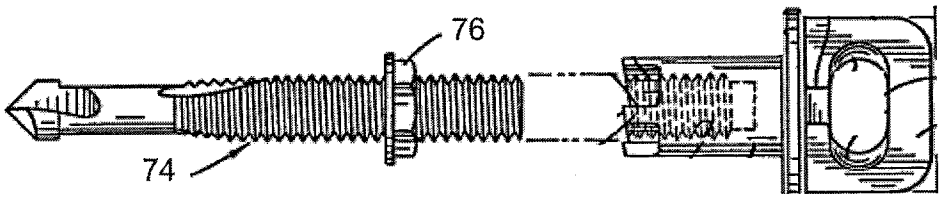
FIG. 8 is a side view of still another embodiment of a stud driver and holder for use in an anchoring system.

Still another embodiment of an exemplary stud holder that is compatible with the present invention is shown in FIG. 8. A threaded stud 74 shown in FIG. 8 may be a stud of the type sold by Heckmann Building Products, Inc. under the trademark POS-I-TIE® and may be used with the stud driver and holder 22 or 64 interchangeably. The threaded stud 74, which may involve a structural screw, is particularly designed to drill and tap through thick steel and is formed with an intermediate hexagonal collar 76. The intermediate hexagonal collar 76 may be used to index the blank from which the stud is formed in a proper angular orientation during formation of the drilling tip and also may be engaged and turned by a wrench if it should be necessary to remove the stud from the supportive wall.

Figure 9A:
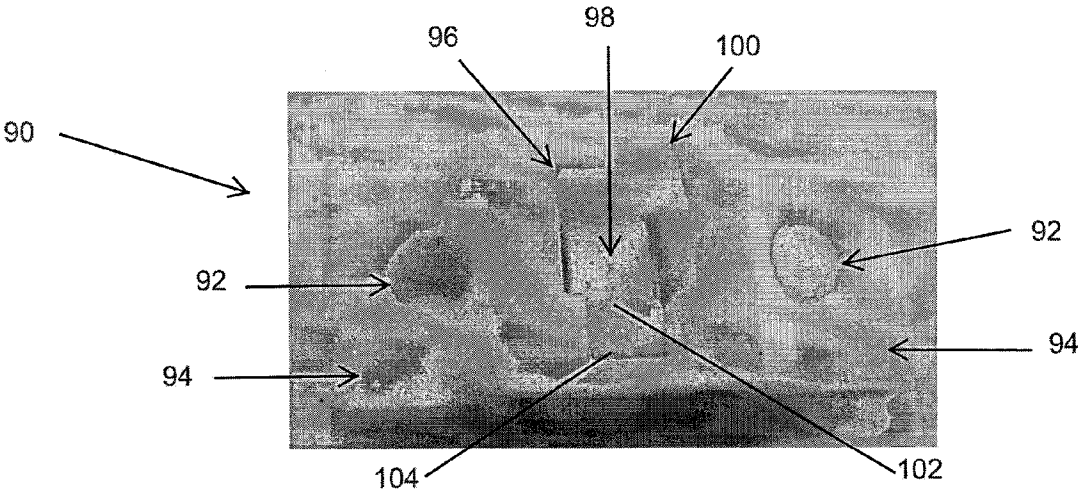
FIGS. 9A and 9B show, respectively, side and bottom views of a thermal clip attachment that can be affixed to an outer driving head of a stud driver and holder in accordance with the present invention.
Figure 9B:
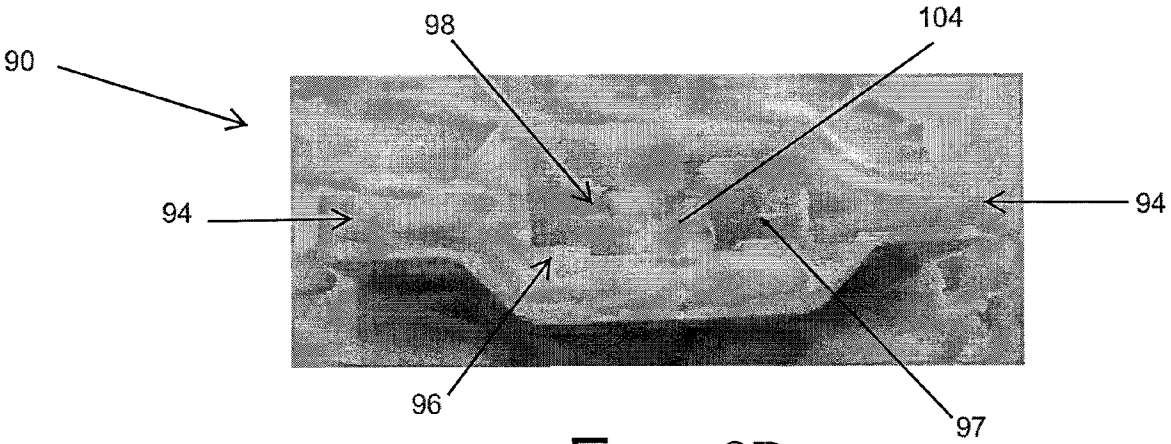
Figure 9D:
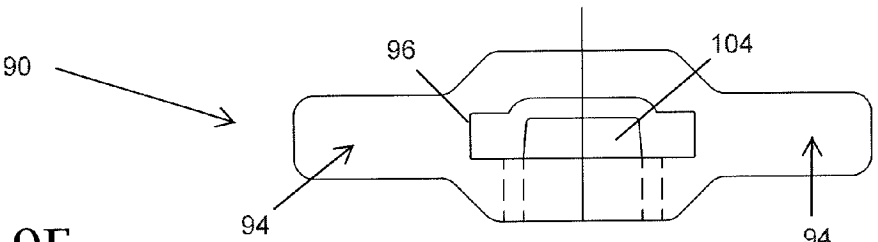
FIGS. 9C through 9G show perspective views of a thermal clip attachment that is similar to that shown in FIGS. 9A and 9B.

Referring now to FIGS. 9A and 9B, once the threaded stud and stud driver and holder have been driven into place, a thermal clip attachment 90 may be affixed to the outer driving head or other attachment part of the stud driver and holder. FIGS. 9A and 9B show, respectively, side and bottom views of merely one embodiment of the thermal clip attachment 90. In this embodiment, the thermal clip attachment 90 may include a hole 92 in each of its outer tabs 94. The holes 92 may receive extensions of a wire tie (not shown) that can be connected to the outer masonry veneer wall. The thermal clip attachment 90 may also have a cavity 96 within which a substantial portion of the outer driving head of the stud driver and holder may be selectively disposed. Edges near a bottom opening 97 of the cavity 96 may be rounded or graded (not shown) for the ingress of components into the cavity 96. Further, a prong 98 may extend downward from a top 100 of the thermal clip attachment 90 to occupy a portion of the cavity 96, and the prong 98 may be offset laterally within the cavity 96. The top 100 of the thermal clip attachment 90 may be a surface that encloses one side of the cavity 96. Also, the prong 98 may have a lip 102 that is sized to catch the eye of the outer driving head of the stud driver and holder 108.

The thermal clip attachment 90 may be formed of a composite material, such as plastic or a plastic resin such as RADEL®, that acts as a thermal break between the outer masonry veneer wall and the stud driver and holder. Moreover, the composite material may be selected such that the prong 98 is laterally displaceable when the outer driving head of the stud driver and holder is forced into the cavity 96. More specifically, the prong 98 may have a sloped surface 104 beneath the lip 102 that is engaged by the outer driving head when the thermal clip attachment 90 is initially forced onto the stud driver and holder. In other embodiments, the thermal clip attachment 90 may be formed from a metal, such as a zinc alloy, stainless steel, or the like. Further, the thermal clip attachment 90 may be formed from a combination of those plastics and metals described above.

As the outer driving head is forced into the cavity 96, the forces acting on the sloped surface 104 begin to displace the prong 98 partially or completely out of the cavity 96. Once the outer driving head is pressed far enough into the cavity 96, the lip 102 of the prong 98 passes into and catches the eye of the outer driving head as the prong 98 snaps back into the cavity 96, affixing the outer driving head within the cavity 96 of the thermal clip attachment 90.

Figure 9C:
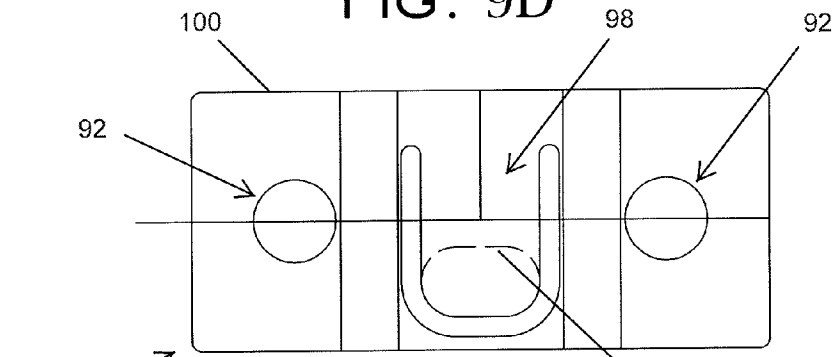
Figure 9E:
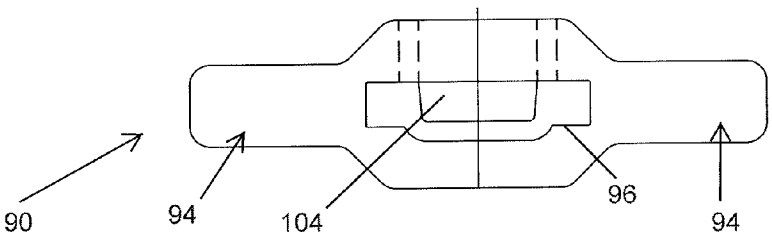
Figure 9F:
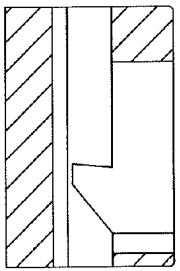
Figure 9G:
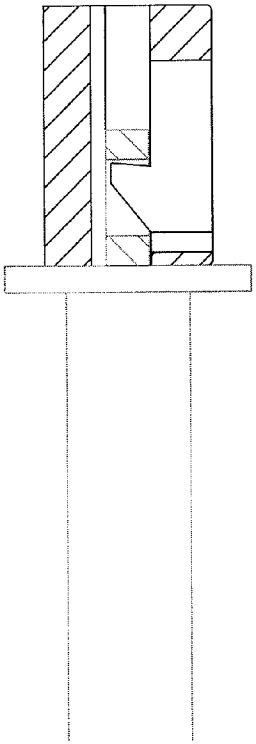

FIGS. 9C through 9G show the perspective views for a thermal clip attachment 90 that is substantially similar to the embodiment shown in FIGS. 9A through 9B. Similar to FIGS. 9A and 9B, FIGS. 9C through 9E show the thermal clip attachment 90 with the holes 92, the outer tabs 94, the cavity 96, the prong 98, the top 100 of the thermal clip, the lip 102, and the sloped surface 104 beneath the lip 102. FIG. 9E shows a bottom cut away view of the thermal clip attachment 90, with the understanding that the bottom of the thermal clip attachment 90 is a solid piece. FIG. 9F is a side cut away view of FIG. 9C, and FIG. 9G shows the thermal clip attachment 90 with a stud driver and holder inserted into the thermal clip attachment.

Figure 10A:
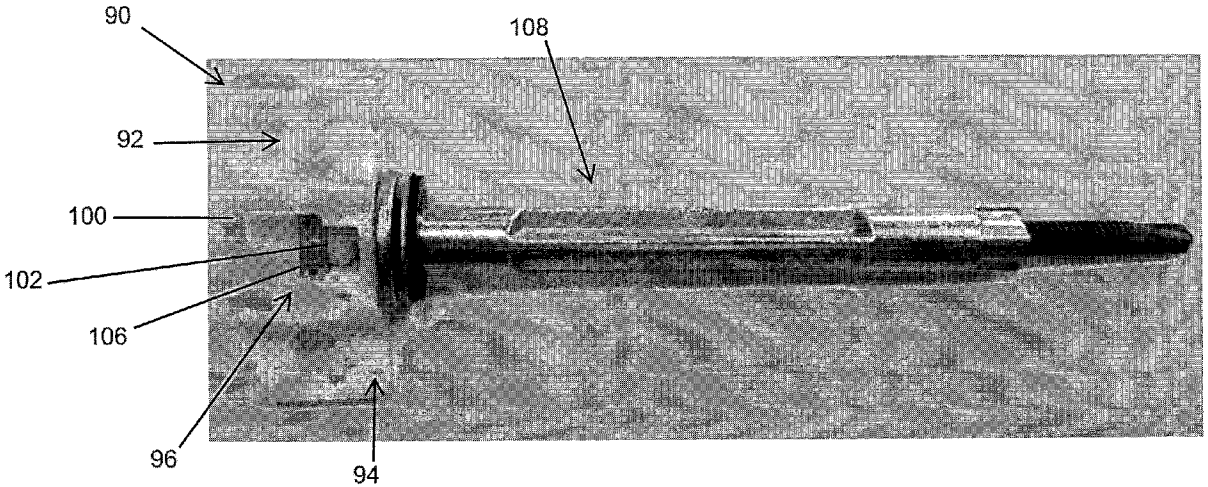
FIGS. 10A and 10B show, respectively, front and back views of the thermal clip attachment of FIGS. 9A-9B affixed to an outer driving head of a stud driver and holder in accordance with the present invention.
Figure 10B:
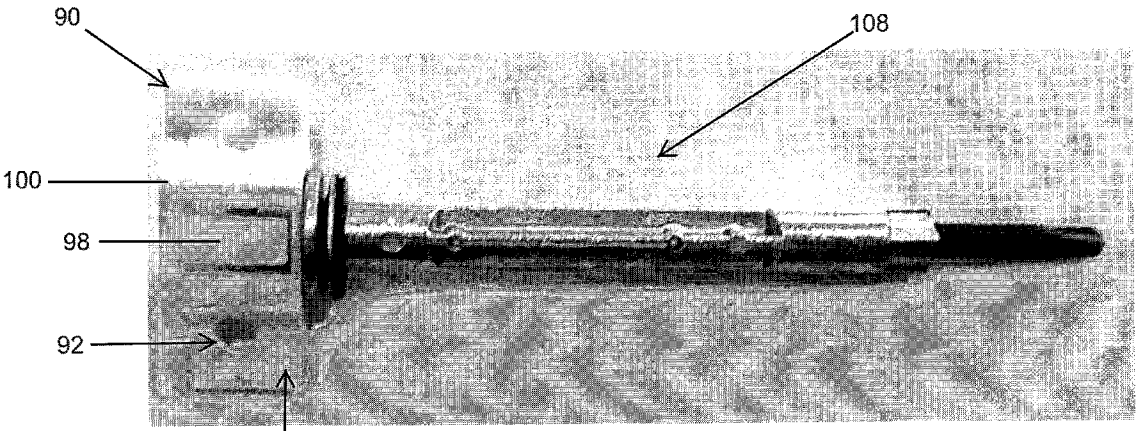

FIGS. 10A and 10B provide, respectively, front and back views of a thermal clip attachment 90 that has been pressed onto an outer driving head 106 of a stud driver and holder 108. It should be noted that the stud driver and holder 108 in FIGS. 10A and 10B have not been driven into insulation and an inner structural supportive wall. Likewise, the particular thermal clip attachment 90 shown in FIGS. 10A and 10B had the top 100 severed from the remainder of the thermal clip attachment 90 for working purposes. In practice, the top 100 may be formed and kept integrally with the thermal clip attachment 90. Notwithstanding, the outer driving head 106 in FIGS. 10A and 10B has been pressed up into the cavity 96 of the thermal clip attachment 90. The prong 98 has already been displaced during the insertion of the outer driving head 106, and the lip 102 of the prong 98 now rests at least partially within an eye of the outer driving head 106.

Because many existing stud drivers and holders already have eyes in their outer driving heads, similar to the eye 44 shown in FIG. 1, the thermal clip attachment 90 is usable with new and existing forms of stud drivers and holders and wire ties, described below. Thus, integration of the thermal clip attachment 90 will be seamless.

Figure 11:
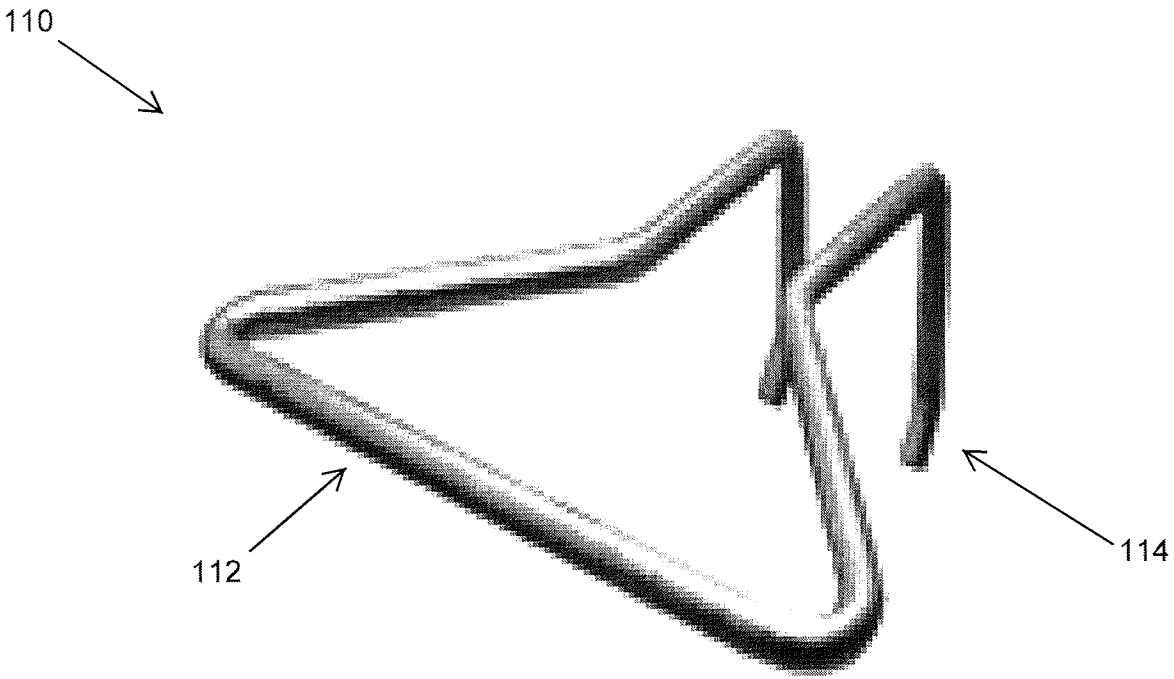
FIG. 11 provides a perspective view of a wire tie that can be used to connect the thermal clip attachment of FIGS. 9A, 9B, 10A, and 10B with an outer masonry wall in accordance with the present invention.

After the thermal clip attachment is affixed to the outer driving head of the stud driver and holder, a wire tie 110 as shown in FIG. 11 may be attached to the thermal clip attachment. The wire tie 110 may include a handling portion 112 and extensions 114. An installer of the wire tie 110 may grip the wire tie 110 by the handling portion 112. The extensions 114 may be placed through the holes on the outer tabs of the thermal clip attachment. The wire tie 110 may assist with rotating the thermal clip attachment and outer driving head such that the holes on the outer tabs of the thermal clip attachment are generally vertical. The extensions 114 may either be inserted upwards or downwards through the holes in the thermal clip attachment. Once inserted, the handling portion 112 of the wire tie 110 may rest along a constituent row of bricks or stones, for example, which form a portion of an outer masonry veneer wall under construction. Mortar may then be placed along the row of bricks upon which the handling portion 112 of the wire tie 110 rests. When the mortar sets up, the wire tie 110 forms a positive lateral load connection between the masonry veneer wall and the inner supportive wall.

FIGS. 12 through 14 show slightly different views of another embodiment of the thermal clip attachment 90. Specifically, FIG. 12A shows a cross-sectional view taken substantially across line 5-5 in FIG. 12B of the thermal clip attachment 90 in a closed position. FIG. 12B shows a side view of the thermal clip attachment 90 of FIG. 12A. FIG. 13A shows a cross-sectional view similar to FIG. 12A, except that the thermal clip attachment 90 is in an open position. FIG. 13B shows a side view of the thermal clip attachment 90, again in a closed position, but with the thermal clip attachment 90 clamped onto an outer driving head 120 of a stud driver and holder 122 (shown in hidden). FIG. 14 shows still another cross-sectional view of the same embodiment, although extensions 114 of a wire tie have been inserted through holes 124 of the thermal clip attachment 90.

The thermal clip attachment 90, as shown in FIGS. 12 through 14, may include a recess 126, which allows a first portion 128 of the thermal clip attachment 90 to rotate relative to a second portion 130 of the thermal clip attachment 90. Such rotation allows for the outer driving head 120 to be inserted into a cavity 132 in the thermal clip attachment 90 when opened. The outer driving head 120 may be affixed within the cavity 132 by arranging an eye 134 of the outer driving head 120 over a peg 136 that is integral with the thermal clip attachment 90. Another peg 138 may be included to further secure the outer driving head 120 within the cavity 132. Once the outer driving head 120 is in place within the cavity 132, the first portion 128 of the thermal clip attachment 90 may be rotated back towards the second portion 130. To fasten the first and second portions 128, 130 back to one another, a fastener 140, such as a rivet, on the first portion 128 may be inserted through a countersink 142 in the second portion 130. The fastener 140 may be formed around one of the holes 124 and may include a deformable flange 144. The deformable flange 144 may be squeezed through the countersink 142 and come to rest in an angled seat 146 of the countersink 142 in the second portion 130. With the deformable flange 144 secured in the angled seat 146 of the countersink 142, the first portion 128 is prevented from rotating relative to the second portion 130. Once the thermal clip attachment 90 is affixed to the stud holder and driver 122, the extensions 114 of a wire tie may be fed through the holes 124 in the thermal clip attachment 90, as shown specifically in FIG. 14.

FIGS. 15 and 16 show still another embodiment of the thermal clip attachment 90. FIG. 15A shows a top view of a closed thermal clip attachment 90, while FIG. 15B shows a side view of the same. Conversely, FIG. 16A shows a top view of the thermal clip attachment 90 of FIGS. 15A and 15B in an open position, while FIG. 16B shows a side view of the same. The thermal clip attachment 90 shown here is similar to the embodiment shown in FIGS. 12 through 14, except that the first portion 128 rotates about a hinge 148 and has at least one clasp 150 that selectively engages at least one curved recess 152 in the second portion 130 when the two portions 128, 130 are closed.

The fastener 140 and other portions of the thermal clip attachment 90 work similarly, if not identically, to the components described above. Thus, for the sake of brevity, the duplicative components of this embodiment are not described again in full.

Figure 17B:
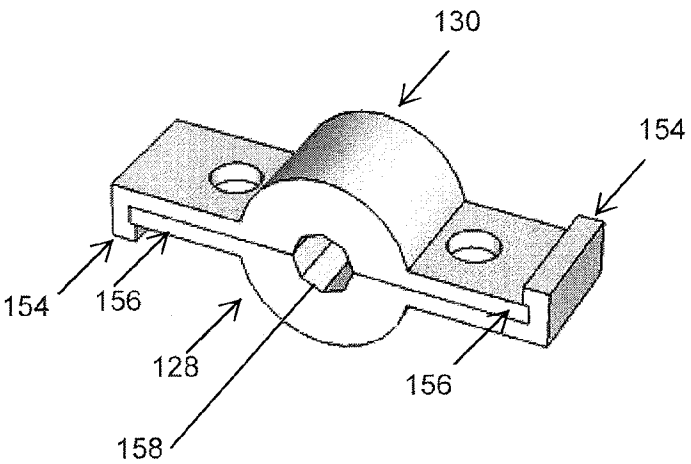
FIG. 17B provides a perspective view of the thermal clip attachment of FIG. 17A, with the first and second portions being slidably engaged in accordance with the present invention.
Figure 17A:
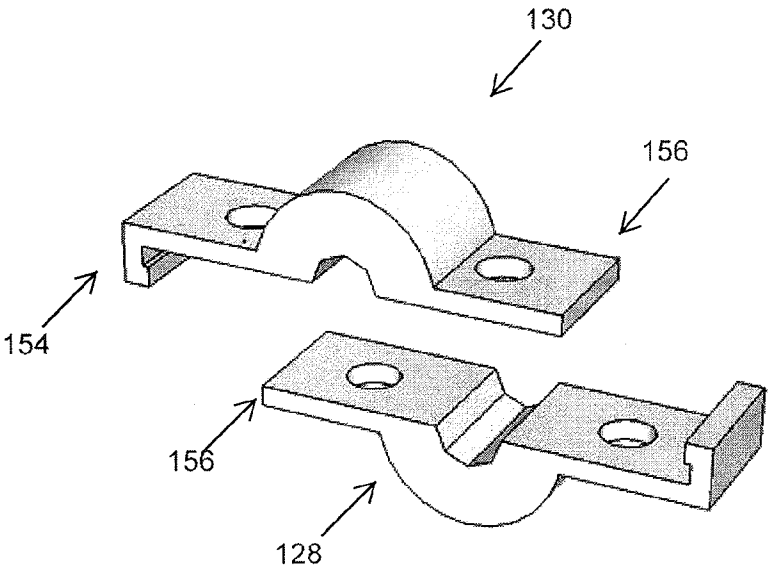
FIG. 17A provides a perspective view of an alternative embodiment of a thermal clip attachment having first and second portions that are slidably engageable in accordance with the present invention.

FIGS. 17A and 17B illustrate an alternative embodiment of the thermal clip attachment 90. This embodiment is similar to the others, but for several distinct features. For one, the first and second portions 128, 130 of the thermal clip attachment 90 may be entirely detachable from one another. Moreover, the first and second portions 128, 130 may even be formed from the same tooling, such that the first and second portions 128, 130 both have a retaining feature 154 and a distal end 156. The first and second portions 128, 130 may be slidably engageable with one another such that the retaining feature 154 of each portion 128, 130 can be placed about the distal end 156 of each portion 128, 130. Although the first and second portions 128, 130 may be slid apart, the retaining features 154 prevent the first and second portions 128, 130 from pulling tangentially away from one another. This embodiment is further different in that the thermal clip attachment 90, when intact, may have a chamber 158, such as an octagonal- or hexagonal-shaped chamber, for example, for receiving a portion of a stud driver and holder. Thus, the thermal clip attachment 90 of FIGS. 17A and 17B may be used with stud drivers and holders that do not have an outer driving head like that shown in FIG. 1.

Figure 18B:
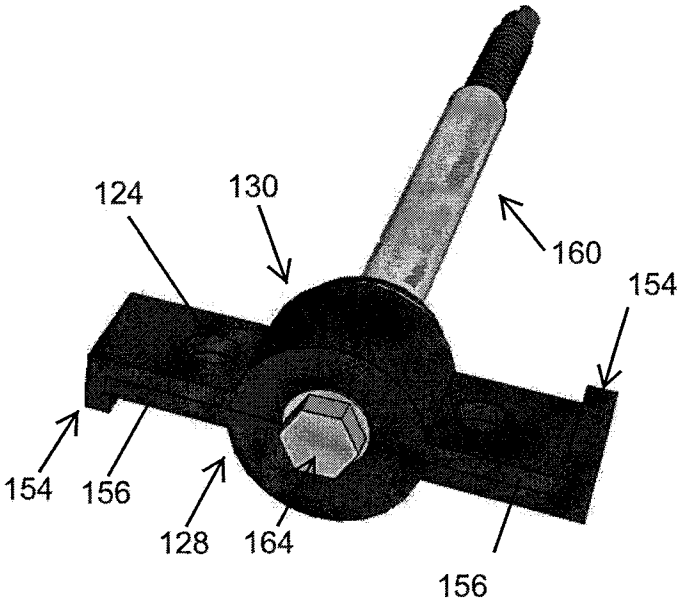
FIG. 18B provides a perspective view of the stud driver and holder of FIG. 18A with the thermal clip attachment of FIGS. 17A and 17B affixed thereto in accordance with the present invention.
Figure 18A:
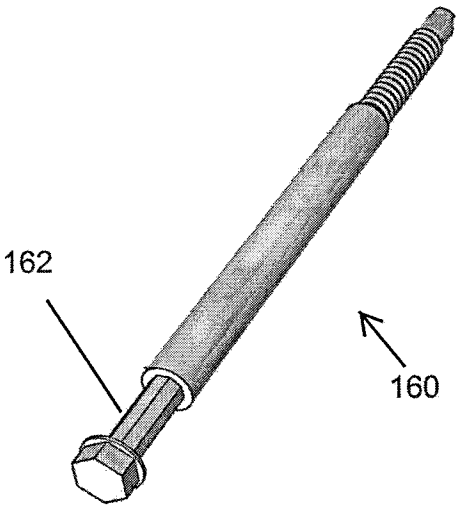
FIG. 18A provides a perspective view of a stud driver and holder to which the thermal clip attachment of FIGS. 17A and 17B may be affixed in accordance with the present invention.

As shown in FIGS. 18A and 18B, the thermal clip attachment 90 of FIGS. 17A and 17B may be attached to a stud driver and holder 160 with a segment 162 having a polygonal cross section that corresponds to the size and shape of the chamber 158 of the thermal clip attachment 90. The segment 162 may be along the shank or barrel of the stud driver and holder 160, for example. In practice, then, once the stud driver and holder 160 is driven into place such that only the segment 162 and, optionally, a washer on the stud driver and holder 160 are protruding from the insulation, the first portion 128 may be placed around the segment 162. The second portion 130 may be slid onto the first portion 130 such that the retaining features 154 and distal ends 156 mate with one another. To further secure the portions 128, 130 to one another and about the stud driver and holder 160, extensions of a wire tie (not shown) may be slid into the holes 124 of the thermal clip attachment 90. At this point, the thermal clip attachment 90 is affixed together and about the stud driver and holder 160. The chamber 158 of the thermal clip attachment 90 can mate with the segment 162 of the stud driver and holder 160 such that the thermal clip attachment 90 is not rotatable about the segment 162 and hence the stud driver and holder 160. Further, the thermal clip attachment 90 is secured between a head 164 of the stud driver and holder 160 and either the insulation (not shown) or a washer (not shown) contacting the insulation.

Figure 19A:
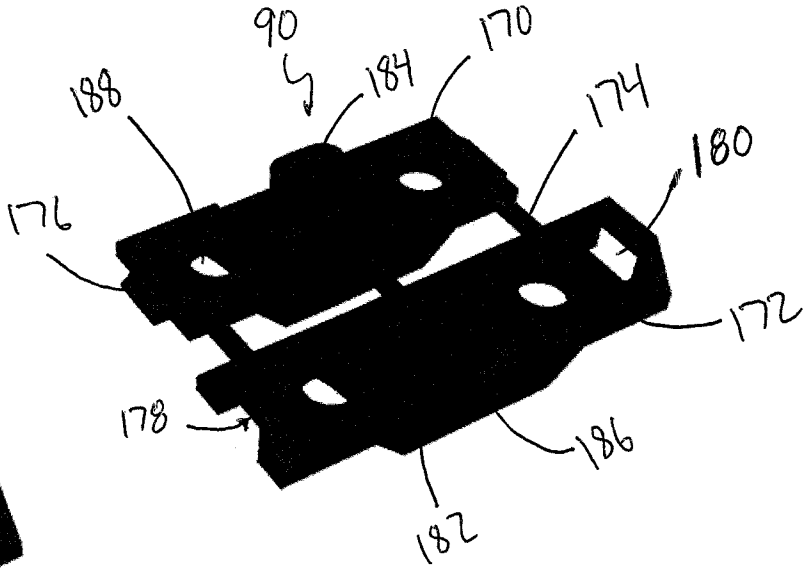
FIG. 19A provides a perspective view of an alternative embodiment of a thermal clip attachment having first and second portions that are engageable, in an open position in accordance with the present invention.
Figure 19B:
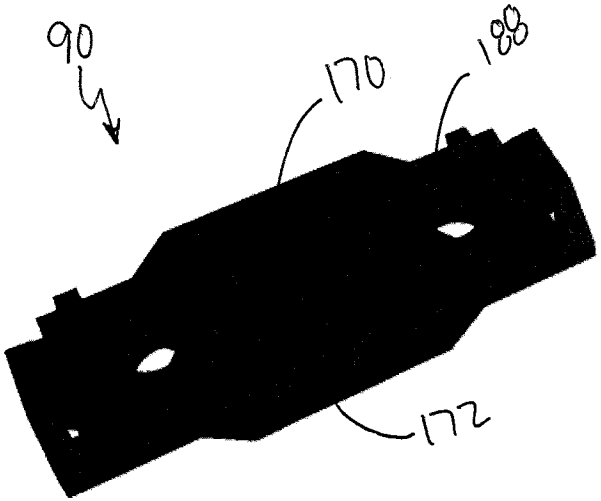
FIG. 19B provides a perspective view of the thermal clip attachment of FIG. 19A, with the first and second portions being engaged in accordance with the present invention.

FIGS. 19A and 19B show still another embodiment of the thermal clip attachment 90. FIG. 19A shows a perspective view of the thermal clip attachment 90 in an open position, while FIG. 19B shows a perspective view of a closed thermal clip attachment 90.

Similar to the thermal clip attachment 90 in FIGS. 16A and 16B, the thermal clip attachment 90 shown here has a first portion 170 and a second portion 172. The first portion 170 rotates about at least one hinge 174, and in the example shown, three hinges. The first portion 170 has at least one tab 176 that selectively engages at least one cavity 178 located on the second portion 172. The cavity 178 may be a pass-through 180 as shown, although such a complete pass-through 180 is not necessary. When the two portions 170, 172 are closed about the hinge 174, the tab 176 will engage and be secured in the cavity 178 thereby creating the closed thermal clip attachment 90 shown in FIG. 19B. The tab 176 and cavity 178 of the thermal clip attachment 90 work similarly to the components of the other thermal clip attachment embodiments described above, and duplicative components of this embodiment are not described again in detail.

Figure 20:
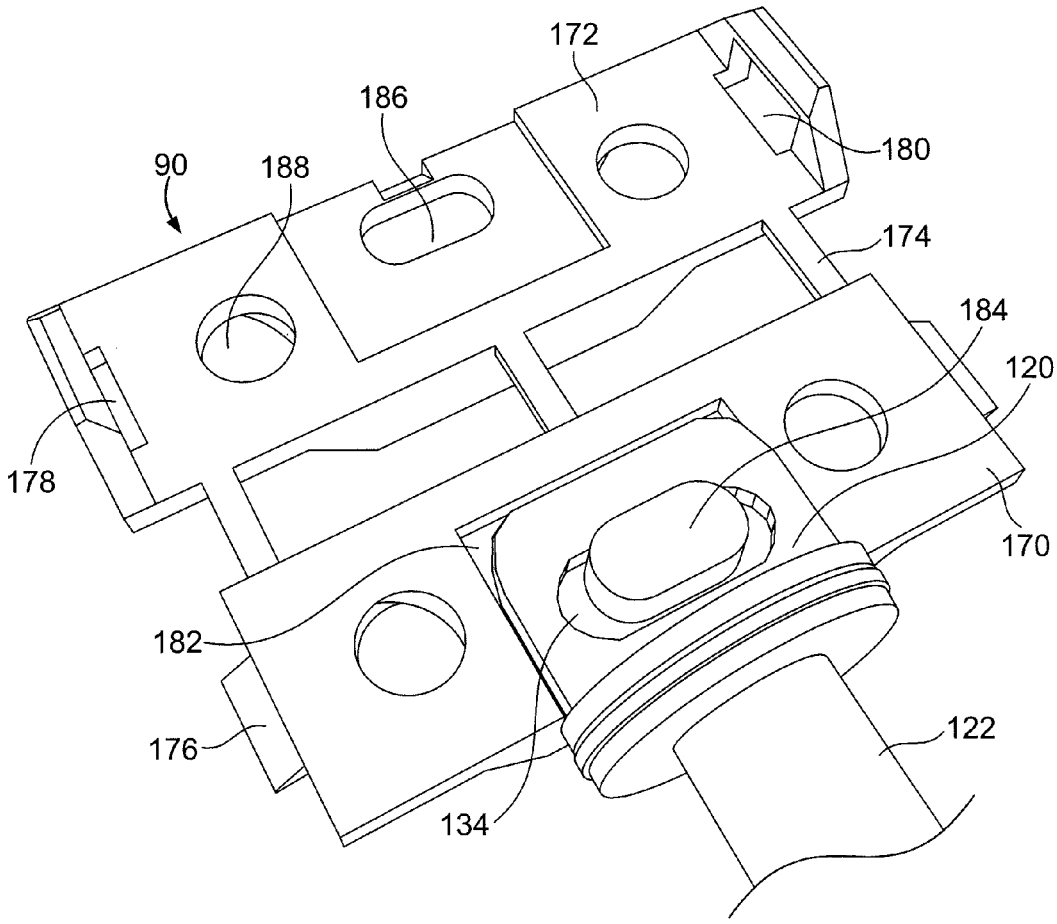
FIG. 20 provides a perspective view of the stud driver and holder of FIG. 8 with the thermal clip attachment of FIGS. 19A and 19B positioned thereto prior to engagement in accordance with the present invention.

As shown in FIG. 20, the first portion 170 of the thermal clip attachment 90 allows for the outer driving head 120 of a stud driver and holder 122 to be affixed in the thermal clip attachment 90 prior to closing. The outer driving head 120 may be affixed by arranging an eye 134 of the outer driving head 120 into a cavity 182 and over a peg 184 that is integral with the first portion 170 of the thermal clip attachment 90. Once the outer driving head 120 is in place within the cavity 182 and over the peg 184, the second portion 172 of the thermal clip attachment 90 may be rotated towards the first portion 170 about the hinges 174. A recess 186 integral in the second portion 172 is configured to receive and accept the peg 184 and further lock in the driving head 120 upon closing. However, the recess 186 may not be necessary to properly contain and secure the driving head 120.

To fasten the first and second portions 170, 172, tab 176 on the first portion 170 engages the cavity 178 on the second portion 172 and locks the two portions 170, 172 together, thereby locking the driving head 120 in place. With the tab 176 secured in the cavity 178, the first portion 170 is prevented from rotating back away from the second portion 172.

Figure 21:
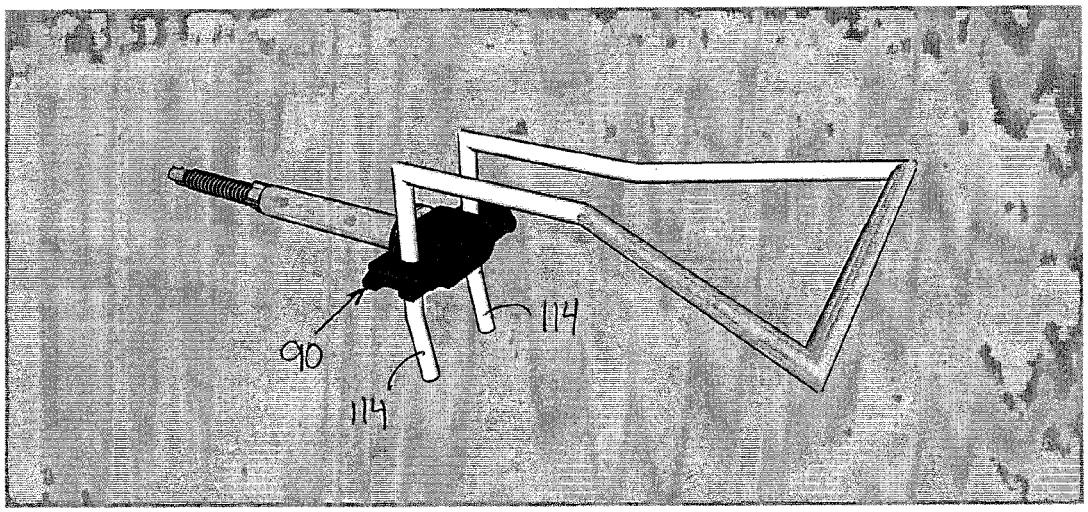
FIG. 21 provides a perspective view of the stud driver and holder with the thermal clip attachment of FIG. 20 engaged with a wire tie attached in accordance with the present invention.

Both the first portion 170 and the second portion 172 contain holes 188 that line up upon closing the thermal clip attachment 90. As such, once the thermal clip attachment 90 is closed as shown in FIG. 19B, and affixed to the stud holder and driver 120, the extensions 114 of a wire tie 110, such as that shown in FIG. 11, may be fed through the holes 188 in the thermal clip attachment 90, as shown specifically in FIG. 21.

It will be appreciated that in addition to the structure of the anchor system and thermal clip attachment described herein, another aspect of the present disclosure is a method for installing masonry anchor systems. It will be further appreciated that the methodology and constituent steps thereof performed and carried out by an installer of the anchor system, and described in great detail above, apply to this aspect of the disclosure with equal force. Therefore, the description of the methodology performed or carried out by an installer using the anchor system and/or thermal clip attachment set forth above will not be repeated in its entirety. Rather, several exemplary steps will be reiterated.

For example, in one embodiment of a method for installing a masonry anchor system, a stud may be located at a position along the insulation. The word "stud" may generally refer to a stud driver and holder, a threaded stud, combinations thereof, or even an integral one-piece stud. The stud may be advanced into an inner structural supportive wall, which may or may not include a layer of insulation. The stud may be advanced such that a part of the stud that is capable of receiving the thermal clip attachment is left protruding from the inner structural supportive wall. This part of the stud may be a segment along the shank of the stud or an outer driving head, for example. The thermal clip attachment may then be affixed to the part. The thermal clip attachment may be rotated to a horizontal position, and extensions of a wire tie may be inserted through holes in the thermal clip attachment. Another part of the wire tie may then be placed along a row of constituents forming an outer masonry veneer wall. Mortar or other cementitious material may be pasted onto the row of constituents and the wire tie as construction of the veneer wall continues.

It should be noted that various steps of this method may occur at different points in time. For example, oftentimes the outer veneer wall is constructed long after the stud is advanced into the inner structural supportive wall. Thus, the steps involving the thermal clip attachment and the wire tie may be performed long after various other steps.

Still another exemplary method of installing the masonry anchor unit may involve preassembling the thermal clip attachment with the wire tie. In particular, the holes of the thermal clip attachment may receive the extensions of the wire tie before the thermal clip attachment is affixed to the stud driver and holder. Further, the extensions of the wire tie may include a retaining feature, such as a kink or notch, for example, that retains the thermal clip attachment on the extensions of the wire tie. The retaining feature may be positioned such that the thermal clip attachment may slide along a portion of the length of each extension. This capability may allow the wire tie to be adjusted up or down depending on the point of attachment with the masonry wall. Once preassembled, the thermal clip attachment with the attached wire tie may be pressed onto the head of the stud driver and holder. This embodiment would thus eliminate the step of having to attach the wire tie to the thermal clip attachment after affixing the thermal clip attachment to the stud driver and holder.

While the disclosure is susceptible to various modifications and alternative forms, specific exemplary embodiments thereof have been shown by way of example in the drawings and have herein been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

What is claimed is:

1. A masonry veneer anchor system comprising:

a stud capable of being advanced into an inner structural supportive wall, the stud having a part that is intended to protrude from the inner structural supportive wall after the stud is advanced, said part that is intended to protrude containing an eye;

a thermal clip attachment attached to the stud after the stud is advanced to the part of the stud that protrudes from the inner structural supportive wall, the thermal clip attachment formed of a composite material that acts as a thermal break between the stud and an outer masonry veneer wall, said thermal clip attachment configured with a peg to engage said eye, wherein said thermal clip attachment is configured with two portions connected by at least one hinge wherein said portions are rotated around said hinge and closed together, thereby securely affixing said stud to said thermal clip attachment; and a wire tie that can be attached to the thermal clip attachment and the outer masonry veneer wall.

2. The masonry veneer anchor system of claim 1, wherein the wire tie further comprises extensions and the thermal clip attachment further comprises holes for receiving the extensions, wherein the extensions of the wire tie can be inserted through the holes of the thermal clip attachment.

3. A method of assembling a masonry veneer anchor system to an outer masonry veneer wall and an inner structural supportive wall, the method comprising the steps of:

locating a stud at a position along the inner structural supportive wall, said stud capable of being advanced into an inner structural supportive wall, the stud having a part that is intended to protrude from the inner structural supportive wall after the stud is advanced, said part that is intended to protrude containing an eye;

advancing the stud into the inner structural supportive wall such that said eye remains protruding from the inner structural supportive wall;

affixing a thermal clip attachment to the eye, said thermal clip attachment formed of a composite material that acts as a thermal break between the stud and the outer masonry veneer wall, said thermal clip attachment configured with a peg to engage said eye, wherein said thermal clip attachment is configured with two portions connected by at least one hinge wherein said portions are configured to be rotated around said hinge and closed together, thereby securely affixing said thermal clip attachment to said stud; and attaching a wire tie to both the thermal clip attachment and the outer masonry veneer wall.

4. The method of assembling a masonry veneer anchor system to an outer masonry veneer wall and an inner structural supportive wall of claim 3, wherein the wire tie further comprises extensions and the thermal clip attachment further comprises holes for receiving the extensions, wherein the extensions of the wire tie can be inserted through the holes of the thermal clip attachment.

5. A masonry veneer anchor system comprising:

a stud capable of being advanced into an inner structural supportive wall, the stud having a part that is intended to protrude from the inner structural supportive wall after the stud is advanced said part that is intended to protrude containing an eye;

a thermal clip attachment attached to the stud after the stud is advanced to the part of the stud that protrudes from the inner structural supportive wall, the thermal clip attachment formed of a composite material that acts as a thermal break between the stud and an outer masonry veneer wall, said thermal clip attachment configured with a peg to engage said eye, wherein the thermal clip attachment has first and second portions that form a cavity for receiving the eye of the stud, wherein the first and second portions are rotated relative one another and fastened to one another with the eye of the stud secured within the cavity of the thermal clip attachment; and a wire tie that can be attached to the thermal clip attachment and the outer masonry veneer wall.

6. The masonry veneer anchor system of claim 5, wherein the wire tie further comprises extensions and the thermal clip attachment further comprises holes for receiving the extensions, wherein the extensions of the wire tie can be inserted through the holes of the thermal clip attachment.

7. A method of assembling a masonry veneer anchor system to an outer masonry veneer wall and an inner structural supportive wall, the method comprising the steps of:

locating a stud at a position along the inner structural supportive wall, said stud capable of being advanced into an inner structural supportive wall, the stud having a part that is intended to protrude from the inner structural supportive wall after the stud is advanced, said part that is intended to protrude containing an eye;

advancing the stud into the inner structural supportive wall such that said eye remains protruding from the inner structural supportive wall;

affixing a thermal clip attachment to the eye, said thermal clip attachment formed of a composite material that acts as a thermal break between the stud and the outer masonry veneer wall, said thermal clip attachment configured with a peg to engage said eye, wherein the thermal clip attachment has first and second portions that form a cavity for receiving the eye of the stud, wherein the first and second portions are rotatable relative to one another and can be fastened to one another with the eye of the stud secured within the cavity of the thermal clip attachment; and attaching a wire tie to both the thermal clip attachment and the outer masonry veneer wall.

8. The method of assembling a masonry veneer anchor system to an outer masonry veneer wall and an inner structural supportive wall of claim 7, wherein the wire tie further comprises extensions and the thermal clip attachment further comprises holes for receiving the extensions, wherein the extensions of the wire tie can be inserted through the holes of the thermal clip attachment.

* * * * *